US005957069A

United States Patent [19]

Shibata

[11] Patent Number: 5,957,069

[45] Date of Patent: Sep. 28, 1999

[54] MULTI-HEAD, MULTI-NEEDLE SEWING MACHINE SYSTEM

[75] Inventor: Masanori Shibata, Ichinomiya, Japan

[73] Assignee: Kabushikikaisha Barudan, Japan

[21] Appl. No.: 08/987,165

[22] Filed: Dec. 8, 1997

[30] Foreign Application Priority Data

Mar. 11, 1997 [JP] Japan ..... 9-74597

[51] Int. Cl.[6] ..... D05B 25/00; D05B 55/16; D05B 49/02

[52] U.S. Cl. ..... 112/155; 112/163; 112/241

[58] Field of Search ..... 112/80.4, 80.41, 112/80.43, 80.44, 163, 155, 165, 167, 246, 221, 241

[56] References Cited

U.S. PATENT DOCUMENTS

| | | | |
|---|---|---|---|
| 4,295,433 | 10/1981 | Desprez et al. | 112/241 |
| 4,924,789 | 5/1990 | Tajima et al. | 112/155 X |
| 5,327,840 | 7/1994 | Tajima et al. | 112/241 X |
| 5,390,613 | 2/1995 | Shibata | 112/80.43 |

*Primary Examiner*—Ismael Iizaguirre
*Attorney, Agent, or Firm*—William A. Drucker

[57] ABSTRACT

The present invention is directed to a multi-head multi-needle sewing machine system adapted to change threads by horizontally moving sewing heads, which system provides for space savings and further increase in the number of sewing heads and colors of threads to be employed. For this purpose, needle-bar support frames 6 are each guided in the horizontal movement thereof by one guide rail 31 horizontally extending over the whole length of a sewing machine system 1. A thread take-up positioning piece 63 for maintaining undriven needle thread take-ups 5 at a raised position is secured to place as extending substantially between the centers of adjacent arms 3. In this multi-head multi-needle sewing machine system 1, the movement ranges of the needle-bar support frames 6 of the respective sewing heads partially overlap with each other but there is no fear of interference therebetween because the needle-bar support frames 6 horizontally travel for the same amount in the same direction. By sharing the guide rail 31 and thread take-up positioning piece 63, the system can accomplish downsizing without suffering trade-off.

8 Claims, 3 Drawing Sheets

MULTI-HEAD, MULTI-NEEDLE SEWING MACHINE SYSTEM

TECHNICAL FIELD

The present invention relates to a multi-head multi-needle sewing machine system and more particularly, to a multi-head multi-needle sewing machine system adapted to change threads by horizontally moving a needle-bar support frame.

BACKGROUND ART

As shown in FIG. 6, the multi-head multi-needle sewing machine system of this type conventionally comprises a plurality of sewing machines 100A arranged in a line, each including a guide rail 102 for guiding a horizontal movement of a needle-bar support frame 101 and a positioning member 104 for guiding needle thread take-ups 103 at rest (see, for example, Japanese Examined Patent Publication Nos. 59(1984)-34386 and 53(1978)-48135). Particularly, the positioning member 104 must have a length W1, W2, W3 of about twice the horizontal length of the needle-bar support frame 101, such that with a far-left needle thread take-up 105L set at a sewing position X, a far-right needle thread take-up 105R may not disengage from the positioning member 104, and vise versa.

Accordingly, the prior-art multi-head multi-needle sewing machine system detrimentally has a great horizontal length because a distance between adjacent sewing machines 100A is about twice the horizontal length of the needle-bar support frame, as seen in the figure. Hence, the conventional multi-head multi-needle sewing machine system cannot accomplish space savings in a sewing plant. Additionally, there has been an obstacle to further increasing the number of sewing heads mounted to the sewing machine system. More recently, a strong demand exists for the use of an even greater number of colors of threads. However, with increase in the number of colors of threads, the greater number of needles must be employed, which results in an increased size of the needle-bar support frame. This further requires the increase in the distance between adjacent sewing heads, naturally resulting in a reduced number of sewing heads mounted to the system. Consequently, a significant reduction of efficiency cannot be avoided.

SUMMARY OF THE INVENTION

It is therefore, an object of the invention to provide a multi-head multi-needle sewing machine system adapted to change threads by horizontally moving the needle-bar support frame, which system contributes to space savings and an increased number of sewing heads or colors of threads to be employed by the system.

Other objects, features and advantages of the invention will be apparent from the following description taken in connection with the accompanying drawings.

For achieving the above object, the multi-head multi-needle sewing machine system according to the invention is characterized by a multi-head multi-needle sewing machine system comprising a plurality of sewing heads horizontally arranged, the sewing head including a needle-bar support frame having a plurality of needle bars and needle thread take-ups, a guide rail for guiding a horizontal movement of said needle-bar support frame, and a thread take-up positioning member for maintaining needle thread take-ups unselected from said multiple needle thread take-ups for the sewing operations at a predetermined swing angle, wherein at least said thread take-up positioning member is shared by at least adjacent sewing heads so as to allow movement ranges of the support frames of adjacent sewing heads to partially overlap with each other.

According to such a multi-head multi-needle sewing machine system, in a case where the far-left needle bar and needle thread take-up of each sewing head are selected for the sewing operations, for example, the far-right needle thread take-up of each sewing head is moved rightward far out of its sewing head. However, since a thread take-up positioning member is shared by adjacent sewing heads, the needle thread take-up moved far out of its sewing head is supported by a portion of the thread take-up positioning member corresponding to the adjacent sewing head, thus prevented from lowering from a predetermined swing angle. At this time, a sewing head on the right has its needle-bar support frame moved far right, too, and therefore, interference with the needle-bar support frame on the right does not occur. Hence, this multi-head multi-needle sewing machine system allows a space between adjacent sewing heads to be reduced to about a half of the maximum range of the horizontal movement of the needle-bar support frame.

In order for the thread take-up positioning member to be shared in this manner, an arrangement may be made, for example, such that the thread take-up positioning members are projected from and extended horizontally of the respective sewing heads in a cantilever fashion, with a space between opposite ends of adjacent thread take-up positioning members defined such that the needle thread take-up can transfer from its thread take-up positioning member to the next one without falling thereoff. However, if the opposite ends of adjacent thread take-up positioning members are at different heights, the needle thread take-up will be caught in the transfer.

Hence, it is more preferred that the thread take-up positioning members span each adjacent sewing heads in a continuous fashion except for an open space defining a path for a swinging needle thread take-up of each sewing head in a driving state, whereby the adjacent sewing heads can share the thread take-up positioning member in the aforementioned manner. With the arrangement wherein the thread take-up positioning members span each adjacent sewing heads, the thread take-up positioning members are integral with adjacent sewing heads, respectively, for elimination of the aforementioned difference in the height thereof. This prevents the needle thread take-up from being caught by or falling off from the thread take-up positioning member. In addition, this arrangement negates the need for cumbersome alignment of the thread take-up positioning members in the fabrication process.

If the needle-bar support frames are directly coupled to each other or otherwise, indirectly coupled to each other by means of a member, such as a horizontal movement shaft, the support frames are prevented from falling off the heads or inclining even when a part thereof does not rest on the guide rail. This is because the whole body of the support frame is supported at multiple points.

However, the invention suggests a more preferred mode thereof wherein the guide rail is also shared by adjacent sewing heads. More specifically, in the more preferred mode thereof, the guide rail for one sewing head is coaxially integral with a guide rail for its adjacent sewing head. This provides more positive guidance of the needle-bar support frames.

In this construction, it is even more preferred that the guide rail comprises one continuous rail extending over the whole length of the system. By virtue of such a jointless guide rail, the horizontal movement of the needle-bar support frames does not involve rattle or vibration caused by the joints.

In the multi-head multi-needle sewing machine system according to the invention, the sewing heads are preferably arranged close to each other so as to define such a distance between the centers of adjacent sewing heads as substantially equal to and a slightly greater than a horizontal length of the needle-bar support frame. This provides the minimum width of the whole body of the sewing system.

According to the invention, at least the thread take-up positioning members are shared by at least adjacent sewing heads, respectively, such that ranges of movement of the needle-bar support frames of adjacent sewing heads may partially overlap with each other. Therefore, an increased number of sewing heads from the prior-art can be mounted in the same space. On the other hand, the construction of the invention requires a smaller space than the prior-art construction to mount the same number of sewing heads. This provides an efficient use of the space in the sewing plant.

BRIEF DESCRIPTION OF THE PREFERRED EMBODIMENT

Figure 1:
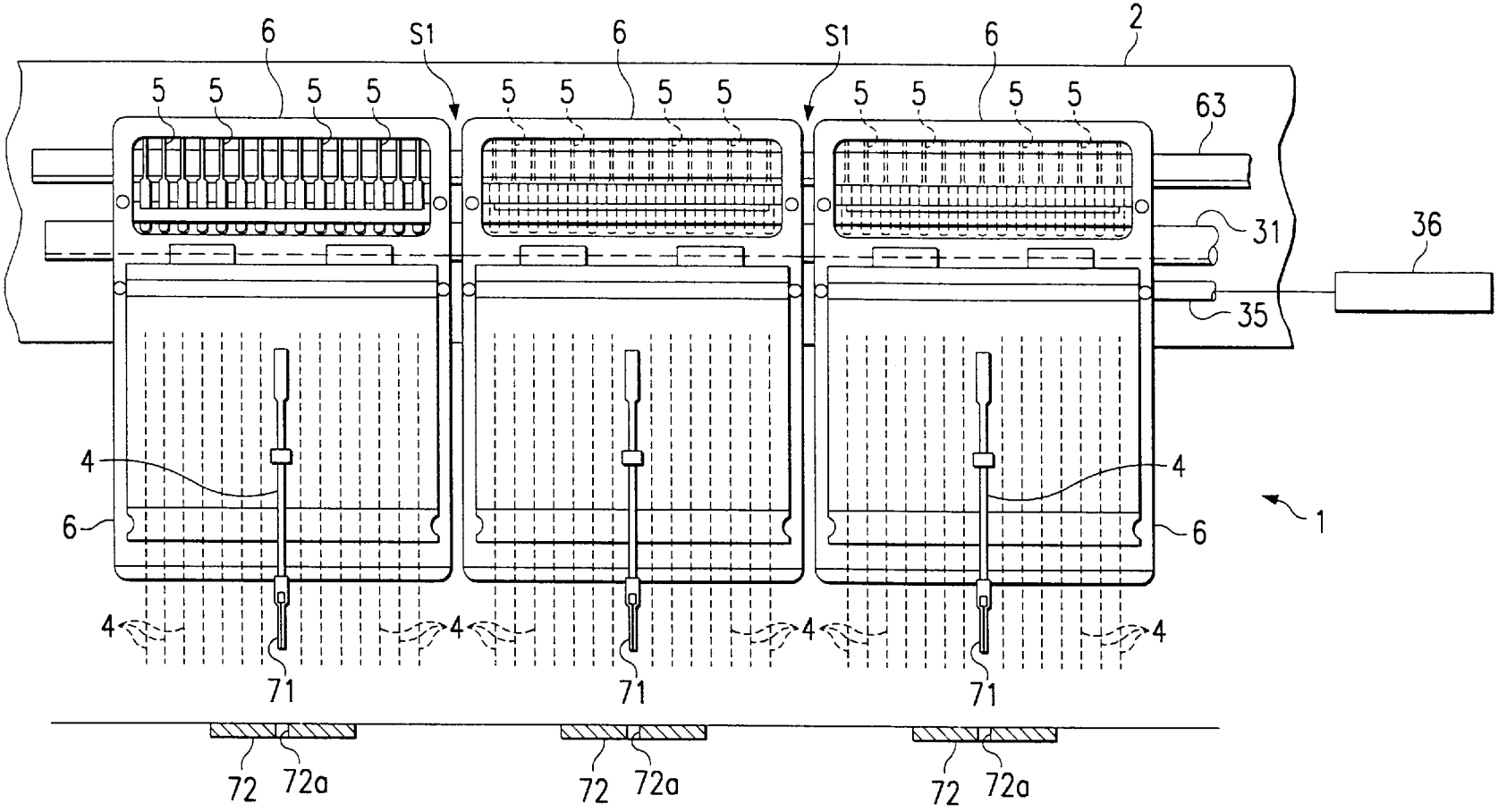
FIG. 1 is a front view illustrating a principal portion of a multi-head multi-needle sewing machine system according to an embodiment of the invention.
Figure 2:
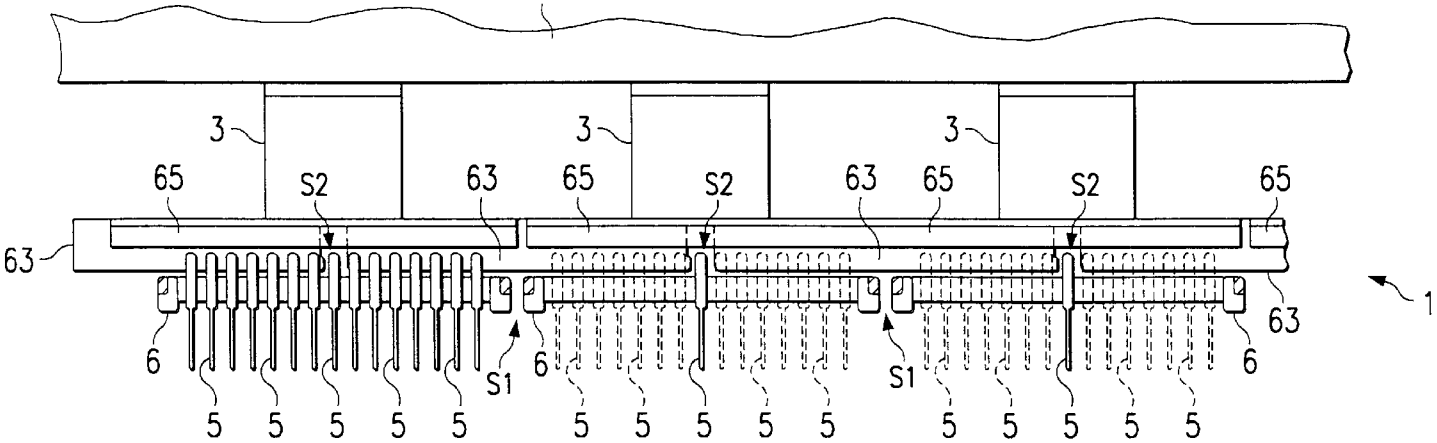
FIG. 2 is a plan view illustrating the principal portion of the multi-head multi-needle sewing machine system according to the embodiment of the invention.
Figure 3:
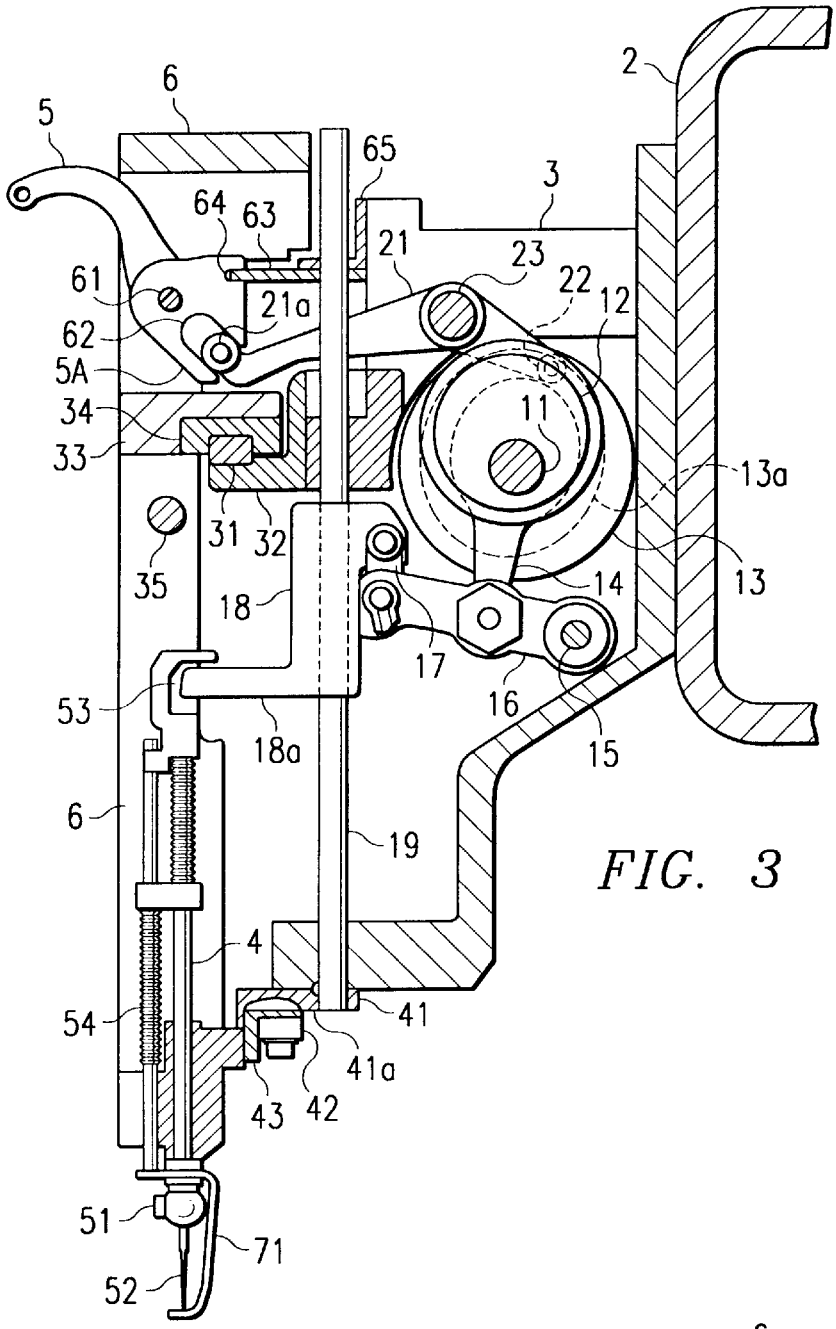
FIG. 3 is a vertical sectional view illustrating the multi-head multi-needle sewing machine system according to the embodiment of the invention.
Figure 4:
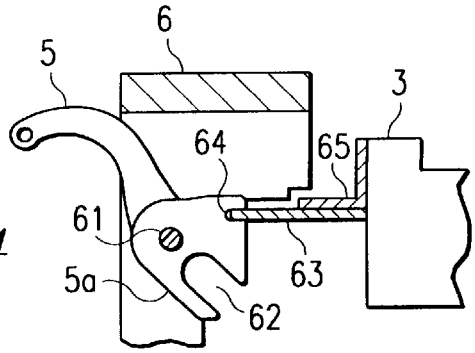
FIG. 4 is a vertical sectional view of the principal portion of the multi-head multi-needle sewing machine system according to the embodiment of the invention for illustrating a needle thread take-up in an unswung state.

A preferred embodiment of the invention will hereinbelow be described by way of reference to the accompanying drawings. FIG. 1 schematically illustrates a part of a multi-head multi-needle sewing machine system 1 according to an embodiment of the invention as seen from the front. FIG. 2 is a plan view of the above. FIG. 3 is a vertical sectional view of a portion above a needle opening 72*a* whereas FIG. 4 is a vertical sectional view.

As seen in the figures, the multi-head multi-needle sewing machine system 1 comprises a bridge 2 and a multitude of arms 3 (comparable to sewing heads as called by the invention) secured to the front side of the bridge 2 at regular intervals. Each arm 3 includes fifteen needle bars 4 and needle thread take-ups. The fifteen needle bars 4 (in most cases 3 to 15 needle bars are provided) are independently vertically movable and retained by a needle-bar support frame 6 horizontally movably attached to the front side of each arm 3.

As shown in FIG. 3, the arms 3 are provided with a drive shaft 11 for driving any of the needle bars 4 and the needle thread take-ups 5. The drive shaft 11 extends substantially over the whole length of the multi-head multi-needle sewing machine system and has eccentric rings 12 and thread take-up cams 13 mounted thereto in correspondence to the respective central portions of the arms 3. Each eccentric ring 12 is fitted with a crank rod 14, which is coupled to the central portion of a link 16 having one end thereof supported by a shaft 15 and the other end thereof coupled to a lever 17. An arrangement is made such that a vertical movement body 18 for driving the needle bar is caused to move vertically by way of the lever 17. The vertical movement body 18 is adapted for the vertical movement as vertically guided by a guide bar 19 secured to the arm 3.

On the other hand, a cam groove 13*a* of each thread take-up cam 13 fittedly receives an end of a thread take-up lever 21 substantially of a bent shape by way of a roller 22. The thread take-up lever 21 is adapted to swing about a thread take-up lever shaft 23 along a given locus on the basis of one swing in one revolution of the drive shaft 11.

Next, description will be made on a construction for the horizontal movement of the needle-bar support frame 6, which characterizes the present invention.

As shown in FIG. 1, the respective needle-bar support frames 6 are guided in the horizontal movement thereof by a guide rail 31 horizontally extending over substantially the whole length of the multi-head multi-needle sewing machine system 1. As shown in FIG. 3, the guide rail 31 rests atop the distal end of a rail mount 32 secured to the front side of the arm 3 and extending forwardly therefrom, and thus is fixed thereto in a horizontal position. The needle-bar support frame 6 is fitted on the guide rail 31 via a moving body 34 attached to a bottom side of a moving-member mount 33 and extending from the back side of the support frame 6. As seen in FIG. 2, the arms 3 are arranged close to each other so that a space between the centers of adjacent arms 3 is substantially equal to a width of the support frame 6 whereby a scanty space S1 is defined between adjacent support frames 6.

The needle-bar support frames 6 are interlocked with each other for movement in unison, and fixed to a color-changing drive shaft 35 horizontally extending over the whole length of the multi-head multi-needle sewing machine system 1. The color-changing drive shaft 35 is responsive to a drive signal from a color changing mechanism 36 to slide axially for a predetermined amount, thereby selectively setting a desired needle bar of the needle-bar support frame 6 to a drive position (directly above the needle opening 72*a*).

The arrangement is made such that the needle-bar support frame 6 is positioned with respect to the forward and backward directions by means of a positioning member 41 disposed under the arm 3. More specifically, a guide plate 43 fixed by screw to the back side of the needle-bar support frame 6 is interposed between a roller 42 fixed by screw to the back side of the positioning member 41 and a bent portion 41*a* extending downwardly of the distal end of the positioning member 41, thereby positioning the needle-bar support frame 6 with respect to the forward/backward directions during the sewing operations.

Within each needle-bar support frame 6, the fifteen needle bars 4 are retained at places as allowed for independent vertical movement. Each needle bar 4 has a sewing needle 52 secured to the bottom end thereof via a needle stopper 51 and a recess 53 formed at a top end thereof for receiving a needle-bar presser 18*a* extending forwardly of the vertical movement body 18. Only one of the fifteen needle bars 4 that is so positioned (directly above the needle opening 72*a*) as to receive the needle-bar presser 18*a* in its recess 53 is selectively caused to vertically move together with the vertical movement body 18 in association with the rotation of the drive shaft 11 and thus, the sewing operation is performed.

Within each needle-bar support frame 6, the fifteen needle thread take-ups 5 each for taking up different threads are swingably mounted to places via a support shaft 61. A base 5A of each needle thread take-up 5 is formed with a recess 62 for receiving a drive element 21*a* at the distal end of the thread take-up lever 21 in the aforementioned selective drive operation, and with a notch 64 for receiving a thread take-up positioning piece (member) 63 horizontally extending forwardly of the stationary arm 3. As shown in FIG. 2, the thread take-up positioning piece 63 is secured to an angled member 65 for mounting thread take-up positioning piece fixed to an upper portion of the front side of each arm 3 in such a manner as to extend substantially between the centers of adjacent arms 3. Defined between adjacent thread take-up positioning pieces 63 is a gap S2 (directly above the needle opening 72*a*) of a predetermined width for allowing the swinging movement of any one of the needle thread take-ups 5. Only one of the needle thread take-ups 5 that comes to a position to receive the drive element 21*a* in its recess 62 or is positioned at the gap S2 is caused to swing in association with the rotation of the drive shaft 11. The other needle thread take-ups 5 are maintained in an raised position by means of the thread take-up positioning piece 63, as shown in FIG. 4.

The needle take-ups 5 unselected for the swinging movement are maintained at an uppermost position by the thread take-up positioning piece 63 while the undriven needle bars 4 are raised to an uppermost position by urging springs 54. When the color changing mechanism 36 performs an operation for changing colors of threads, a rotary angle of the drive shaft 11 is controlled such that the vertical movement elements 18 are raised to an uppermost position while the thread take-up levers 21 are stopped at a position to raise the needle thread take-ups 5 to the uppermost position. This facilitates the change of needle bars 4 and needle thread take-ups 5. In FIGS. 1 and 3, a reference numeral 71 denotes a presser-foot whereas a reference numeral 72 denotes a throat plate.

Figure 6:
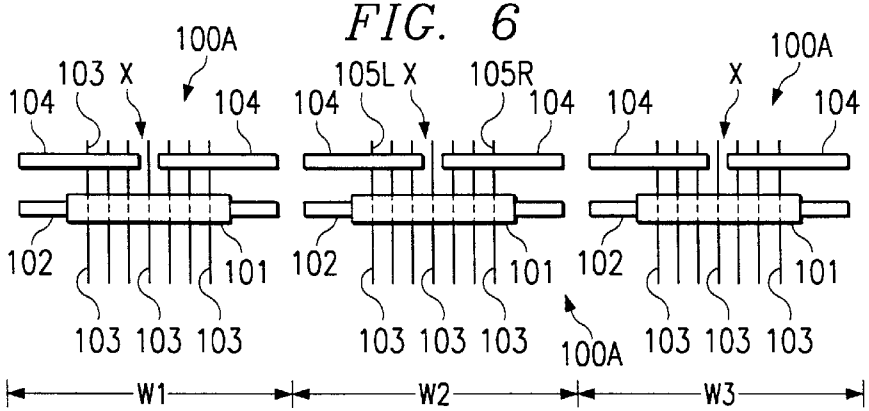
FIG. 6 is a schematic diagram illustrating the prior-art multi-head multi-needle sewing machine system.
Figure 5:
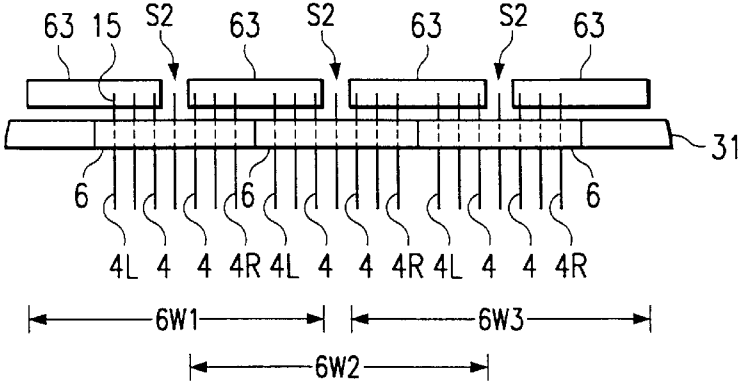
FIG. 5 is a schematic diagram illustrating the action and effect of the multi-head multi-needle sewing machine system according to the embodiment of the invention.

In the multi-head multi-needle sewing machine system constructed as mentioned above according to the embodiment of the invention, as shown in FIG. 5, movement ranges 6W1 to 6W3 of the needle-bar support frames 6 for the sewing heads (each containing seven needle bars for correspondence with those shown in FIG. 6) partially overlap with each other. Hence, when either the far-left needle bar 4L or the far-right needle bar 4R is selected, the needle-bar support frame 6 is moved to a place such that the frame overlaps with a part of the adjacent sewing head. However, the needle-bar support frame 6 for the adjacent sewing head is also moved in the same direction so that the positional interference between these support frames is avoided. Additionally, the common color-changing drive shaft 35 is used for horizontally moving the needle-bar support frames 6 thereby allowing the support frames to move in unison without cumbersome settings such as synchronization between the heads. Besides, there occurs no interference between them during the movement thereof. Furthermore, the thread take-up positioning piece 63 spans adjacent arms 3, thus eliminating a fear of any undriven needle thread take-up 5 failing to be guided.

Thus, the sewing machine system according to the embodiment of the invention presents excellent effects, such as notable reduction in the overall widthwise dimension thereof without entailing disadvantages in the sewing operations, and easy settings for the operations thereof. This contributes to further increase in the number of sewing heads and of colors of threads to be mounted in the same space.

Although the present invention has been described by way of an example of one embodiment thereof, it should be appreciated that the invention should not be limited to the above but may be otherwise variously embodied without departing from the inventive concept of the invention.

For example, although the guide rail 31 of the aforementioned embodiment comprises one continuous rail extending over the whole length of the system, the guide rail 31 may include several missing portions. Since the whole bodies of the needle-bar support frames 6 are coupled to each other by means of one color-changing drive shaft 35, the respective needle-bar support frames 6 are prevented from disengaging from the guide rail even if they are not completely set on the guide rail. In this case, the opposite ends of adjacent guide rail sections may preferably be rounded for smooth transfer of the support frame 6 from a guide rail section to that adjacent thereto. Incidentally, the guide rail comprising one continuous rail like that of the embodiment described in detail is more advantageous in that the rail is readily positioned horizontally.

It is obvious to those skilled in the art that changes and variations thereto besides the above may be made without changing the gist of the invention.

As many apparently widely different embodiments of this invention may be made without departing from the spirit and scope thereof, it is to be understood that the invention is not limited to the specific embodiments thereof except as defined in the appended claims.

What is claimed is:

1. A multi-head, multi-needle sewing machine system comprising: a plurality of sewing heads, horizontally arranged, each sewing head including a needle-bar support frame having a plurality of needle bars and needle thread take-ups, a guide rail for guiding a horizontal movement of said needle-bar support frame, and a thread take-up positioning member for maintaining needle thread take-ups unselected from said multiple needle thread take-ups for the sewing operations at a predetermined swing angle, at least said thread take-up positioning member being shared by at least adjacent sewing heads to allow movement ranges of the support frames of adjacent sewing heads to partially overlap each other.

2. A multi-head, multi-needle sewing machine system as set forth in claim 1, wherein said thread take-up positioning member extends across adjacent sewing heads in a manner to define a space for a path of a swinging needle thread take-up of each sewing head, to allow the adjacent sewing heads to share the thread take-up positioning member.

3. A multi-head, multi-needle sewing machine system as set forth in claim 1, wherein said guide rail is also shared by adjacent sewing heads.

4. A multi-head, multi-needle sewing machine system as set forth in claim 3, wherein said guide rail is coaxially integral with a guide rail for adjacent sewing heads.

5. A multi-head multi-needle sewing machine system as set forth in claim 4, wherein said guide rail comprises one continuous rail extending over the whole length of the system.

6. A multi-head multi-needle sewing machine system as set forth in any one of claims 1 to 5, wherein said sewing heads are arranged close to each other so as to define a distance between the centers of adjacent sewing heads substantially equal to and slightly greater than a width of said needle-bar support frame.

7. A multi-head, multi-needle sewing machine system as set forth in claim 2 wherein said guide rail is also shared by adjacent sewing heads.

8. A multi-head, multi-needle sewing machine system as set forth in claim 5 wherein said guide rail is coaxially integral with a guide rail for adjacent sewing heads.

* * * * *